United States Patent [19]

Génevois et al.

[11] 4,215,982

[45] Aug. 5, 1980

[54] CONTINUOUS RING FURNACES FOR BAKING AND REBAKING CARBON ARTICLES

[75] Inventors: Jean L. Génevois, Milan; Renato Piva, Ascoli Piceno; Antonio Lucia, Terni, all of Italy

[73] Assignee: Elettrocarbonium S.p.A., Milan, Italy

[21] Appl. No.: 791,692

[22] Filed: Apr. 28, 1977

[30] Foreign Application Priority Data

May 5, 1976 [IT] Italy ..... 49336 A/76

[51] Int. Cl.[2] ..... F27B 13/00

[52] U.S. Cl. ..... 432/192; 432/152; 432/190

[58] Field of Search ..... 432/152, 190, 192

[56] References Cited

U.S. PATENT DOCUMENTS

| | | | |
|---|---|---|---|
| 3,048,382 | 8/1962 | Mansfield | 432/192 X |
| 4,049,900 | 9/1977 | Genevois et al. | 13/7 |

FOREIGN PATENT DOCUMENTS

| | | | |
|---|---|---|---|
| 2214370 | 9/1974 | France | 432/192 |
| 5013288 | 5/1975 | Japan | 432/192 |
| 771632 | 4/1957 | United Kingdom | 432/152 |

*Primary Examiner*—Martin P. Schwadron
*Assistant Examiner*—Richard Gerard
*Attorney, Agent, or Firm*—DeLio and Montgomery

[57] ABSTRACT

The invention provides improvements in continuous ring furnaces which have sequentially arranged and communicating chambers and which are used for baking and rebaking carbon articles, wherein a movable bridge member is employed to connect a common smoke channel with a first chamber, so as to draw a portion of smoke flowing through said smoke channel and recycle the same through the furnace.

2 Claims, 7 Drawing Figures

CONTINUOUS RING FURNACES FOR BAKING AND REBAKING CARBON ARTICLES

This invention relates to improvements in the well-known continuous Hoffman-type furnaces and, more specifically, an improvement in the ring furnaces for baking and rebaking carbon articles.

Such carbon articles are generally made of an amorphous material, as petroleum coke, anthracite, soot and the like, prepared in the form of powder and bound by means of a binder, as pitch, tar, resins and the like. The articles are preshaped in a process usually called "preparation of the raw article" by extrusion, pressing, vibration, beating and the like.

After this step, it is necessary to bake the "raw" articles to coke the binder and to confer the article with the desired characteristics, as mechanical strength, electrical conductivity and so on.

The article which is obtained after this baking process is called "amorphous" and can be utilized as it is, for example in the case of anodes and cathodes for the aluminium electrolysis, amorphous electrodes, lining of furnaces, and the like, or the article can be used for graphitizing, both directly and after an impregnation process and a following rebaking process, as in the case of electrodes for steel producing furnaces.

The conventional continuous ring furnaces of the Hoffman-type generally comprise a number of chambers, each divided into muffles, these chambers being arranged in a side-by-side relationship to form an elongated closed ring. The energy for the heating process is provided by liquid or gaseous fuel, burning in correspondence with one or more chambers, being heated to the maximum temperature, in countercurrent with respect to an air flow which is admitted just before the chambers being cooled and exchanges heat therewith. After the combustion process, the hot smoke is fed to the chimney by a fan, but such smoke is firstly forced to exchange heat with the chambers opposite to the chambers being cooled, that is with the chambers being preheated. Intaking and exhausting operations are performed in the other chambers which are not involved in the gas flow.

The continuity of the thermal cycle is assured by moving the fire to the next chamber being pre-heated and then circumferentially moving the situation set forth, to the next chamber in the direction of the smoke flow. The time from one movement to the next, which is called the furnace pitch, depends on many factors, such as the number of furnace chambers, the thermal cycle to be realized, the time required to perform the intaking and exhausting operations and the like.

During the operations to which the carbon articles are subjected in the furnace, volatile substances from the binder during the baking process and from the impregnant during the rebaking process, are directly fed into the chimney in such furnaces.

In case the chimney is not provided with a filter for eliminating these volatile substances, smoke is emitted which pollutes the environment.

Should the chimney be provided with a filter, and usually electrostatic filters are used, the condensable tarry vapors are eliminated, in the form of fogs, for approximately 95 to 98%. Moreover such a filter is effective only with condensable substances.

According to the invention, on the contrary, a portion of the smoke is fed into the chimney, after the smoke has exchanged heat with the chambers being pre-heated and has charged both with the volatile substances, developed during the distillation process, and with the "parasitic" air which inevitably penetrates the chambers being pre-heated, and particularly the chambers at the highest vacuum, despite the impermeabilization treatments to which the furnaces chambers are usually subjected. This portion of smoke is recycled (by a suitable means) instead of the air (or a portion of it), which is usually admitted into the last chamber of the series of chambers being cooled.

In order to obtain this result, it has been devised to connect the last chamber with the smoke channel by means of a movable member provided with a fan.

According to the invention, two embodiments of the movable member are provided depending on the ring furnace configuration. Particularly, this will be of the bridge type in connection with the furnaces where the lower cavity of the chambers can be connected to the smoke channel, through a suitable passage provided with opening and closing means controlled from outside, or of the cover type in connection with the furnaces where this connection is impossible.

Thus, the following advantages are obtained:

a decrease in the quantity of gas passing through the filter, and then an absolute decrease in the quantity of vapors, for example tar vapors, which cannot be eliminated by the filter, and consequently would be exhausted into the atmosphere directly, an increase in the thermal efficiency of the furnace since a portion of the heat of the burnt gases which are recycled is regenerated (which gases, however, are cold enough to cool the articles at a higher temperature contained in the chamber in which the gases are admitted, this chamber being at the initial cooling step), a decrease in fuel consumption since a certain quantity of calories is obtained by combustion of the unburnt substances contained in the recycled gases, in the fire chambers; as mentioned above, a portion of these substances being incondensable, will by no means be eliminated by the filtering device, a vacuum decrease in all the covered chambers, which reduces the likelihood of indesirable parasitic air penetrating the chambers through the inevitably imperfected refractory structures of the furnace, an oxidation of substances which would cause, when exhausted into the atmosphere, higher pollution.

The invention will be disclosed in detail in connection with two embodiments thereof. A first embodiment is intended to be used in connection with Hoffman-type ring furnaces provided with a side outlet from the chamber bottom connecting the chamber to the smoke channel, which furnaces will be here referred to as the "standard type furnaces"; the second embodiment is intended to be used in connection with Hoffman-type furnaces not provided with such outlet, which furnaces will be here referred to as the simple-type furnaces.

Such embodiments are illustrated in the annexed drawings, wherein.

In order to make easier the understanding of the invention, a summary description will be now given of the Hoffman-type ring furnace operation, in connection with the embodiments of the present invention.

Figure 1:
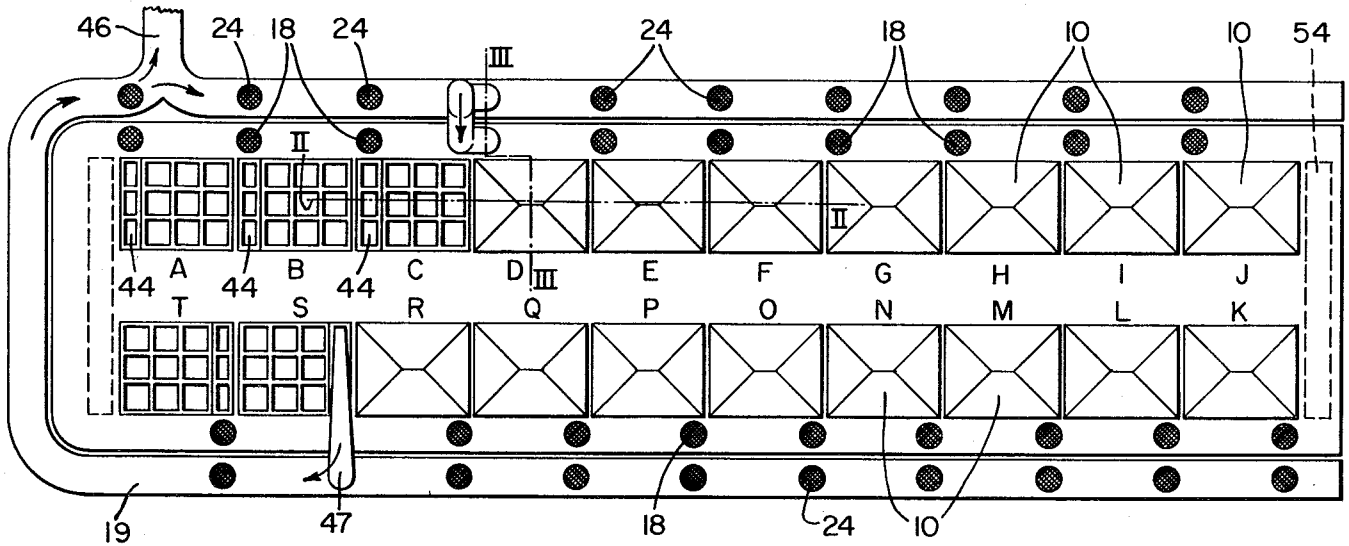
FIG. 1 is a diagrammatic top view of a standard ring furnace with one of the chambers connected to the smoke channel through a movable member, according to the first embodiment of the invention.
Figure 4:
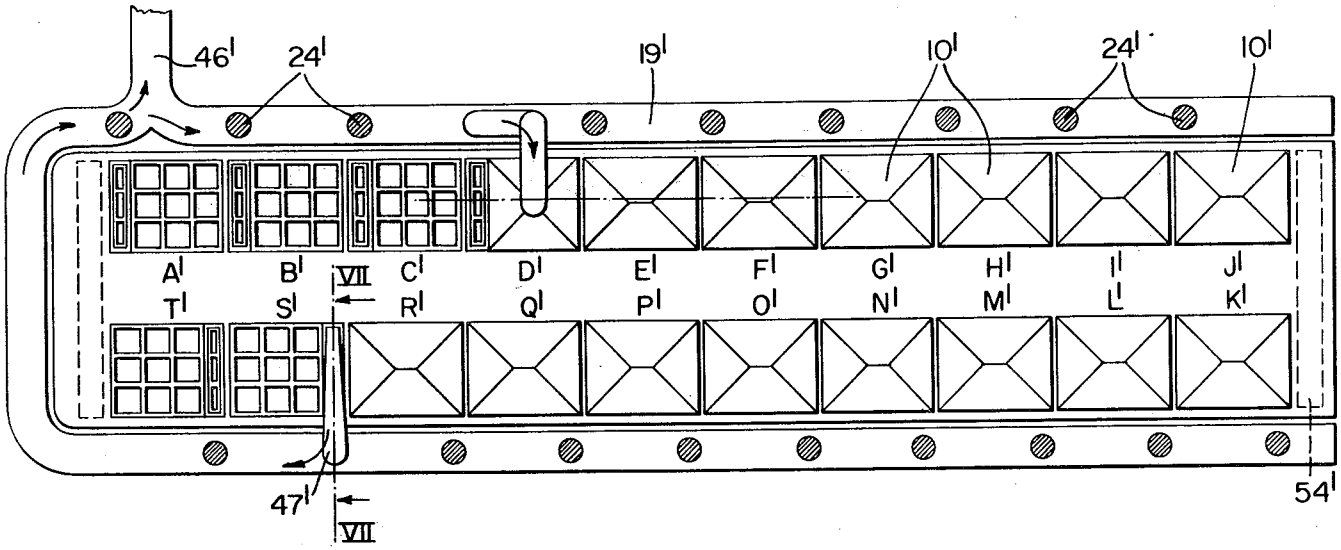
FIG. 4 is a diagrammatic top view of a simple ring furnace, with one of the chambers connected to the smoke channel through a movable member, according to the second embodiment of the invention.

Both furnaces shown in FIGS. 1 and 4 are provided with twenty chambers and they are represented in the same condition, that is:

chambers F and G are the "fire" chambers, that is combustion is taking place therein and accordingly there is the maximum temperature;

chambers H through R are being pre-heated by the combustion smoke; chamber S is being charged;

chamber T is in maintenance;

chamber A is being discharged;

chambers B and C are under forced cooling without covers (indicated at 10);

chambers D and E are being cooled.

In this condition, according to the invention, the recycled smoke is drawn into chamber D. Should the air in the smoke be unsufficient for combustion, or the quantity of the recycled smoke be excessive, a cold air shuttered inlet should be provided in chamber D.

Figure 2:
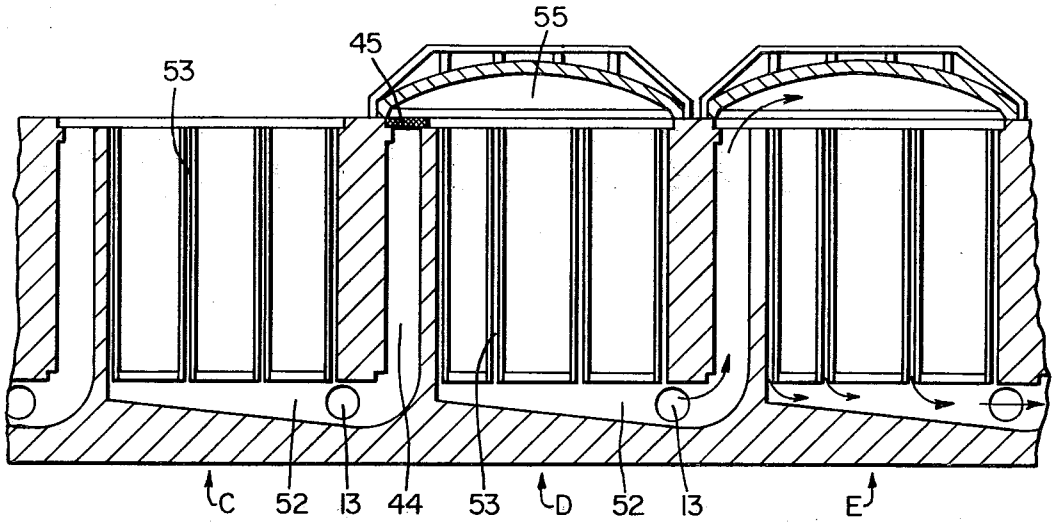
FIG. 2 is an enlarged fragmentary vertical sectional view, along line II—II of FIG. 1.

Burners of chambers F and G are operating and in communication with the fluid or gaseous fuel feeding pipe (not shown), with the combustion smoke passing from chambers F and G to the chambers next in the cycle, since each chamber is connected to the next one by the lower and vertical passages 52 and 53, respectively; end chambers J and K being connected through transversal passage 54 (FIGS. 1 and 2).

Combustion smoke is then exhausted towards annular smoke exhausting channel 19 of which outlet 46 is leading to the filter (not shown) and therefore to the chimney, through the last of the chambers being pre-heated, that is chamber R, which is connected to smoke channel 19 by a movable hood 47, as it is usual in such furnaces.

In these ring furnaces vacuum is created which is increasing from the fire chambers on and reaches a maximum value in chamber R, communicating directly with smoke exhausting channel 19, and a minimum value in chamber D.

As mentioned above, this situation is moved to the next chamber clockwise viewing FIGS. 1 and 4, shifting a same operation from one chamber to the next one.

Figure 3:
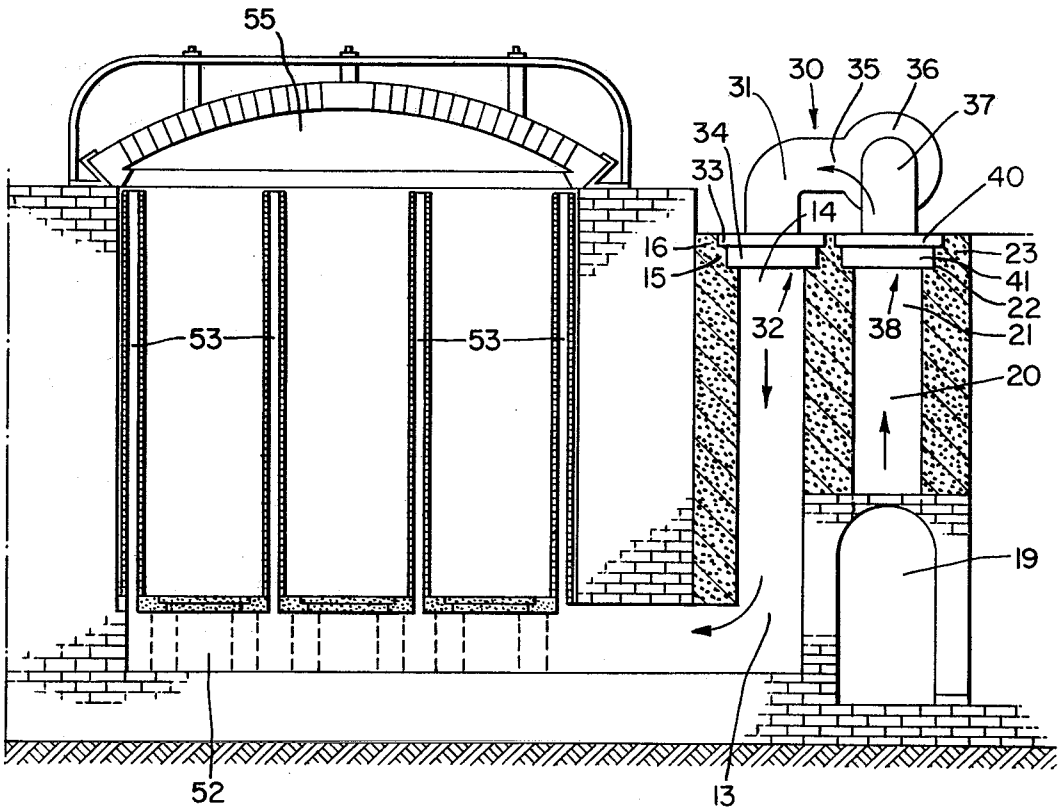
FIG. 3 is a more enlarged vertical sectional view along line III—III of FIG. 1.

Particularly with reference to FIGS. 1, 2 and 3, the first embodiment of the member according to the invention will be now disclosed, the embodiment being intended to be a ring furnace of the standard-type as mentioned above.

In such a furnace lower cavity 52, connected to chamber crown 55 by hollow partitions 53 is provided with a side exhausting passage 13 having an inlet 14 shaped with a double step, as indicated at 15 and 16 and adapted to be closed by a plug 18.

Smoke channel 19 runs along the chambers externally of the side passage 13 and, in correspondence with each chamber, is provided with a vertical passage 20 having an connecting passage 21 similarly shaped with two steps 22 and 23 and adapted to be closed by a plug 24, connecting passage 21 of each vertical passage 20 being adjacent to inlet 14 of the correspondent side passage 13.

With such structure of the furnace, according to the invention the use is provided of a bridge member 30, comprising a first vertical tube length 31 a portion of which has an outer member 32 formed with two steps 33 and 34 and adapted to seal inlet 14 of side passage 13; a horizontal tube length 35 in which a fan 36 is placed and then a second vertical tube length 37 with an inlet having an outer member 38 shaped with two steps 40 and 41 and adapted to seal connecting passage 21 of vertical passage 20.

In operation, in the furnace illustrated in FIG. 1, plug 18 of side passage 13 of chamber D and plug 24 of the correspondent vertical passage 20, in communication with smoke channel 19, are removed. The first vertical tube length 31 of member 30 is placed on inlet 14 and the second vertical length 37 is placed on connecting passage 21 of the correspondent vertical passage 20 of smoke channel 19; fan 36 is then operated which draws a portion of smoke from channel 19 and forces it into side passage 13, to cavity 52 and then to hollow partitions 53.

The smoke drawn in this way from smoke channel 19 will be fed from chamber D to chamber E being cooled, and then to fire chambers F and G, while the smoke cannot be fed to the uncovered chamber C, owing to closure 45 placed on fire pit 44.

Figure 5:
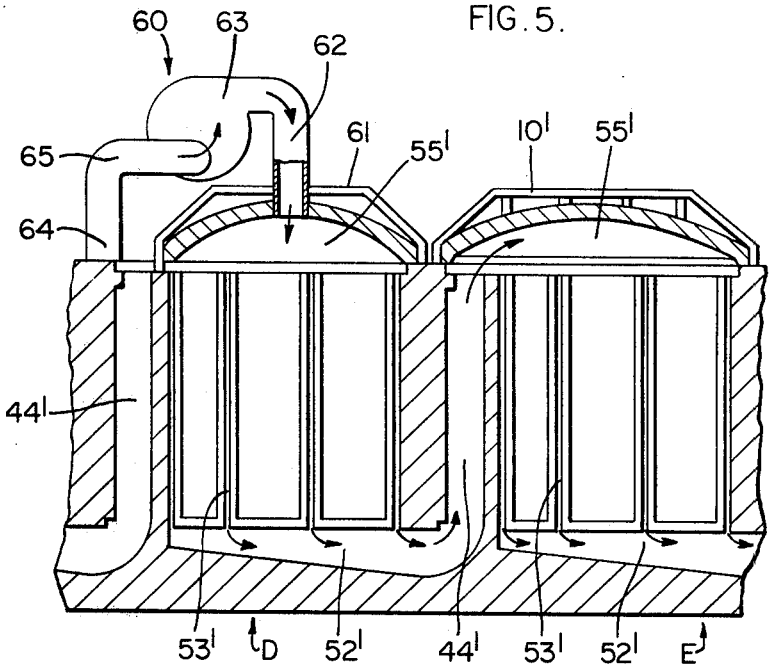
FIG. 5 is an enlarged vertical sectional view along V—V of FIG. 4.
Figure 7:
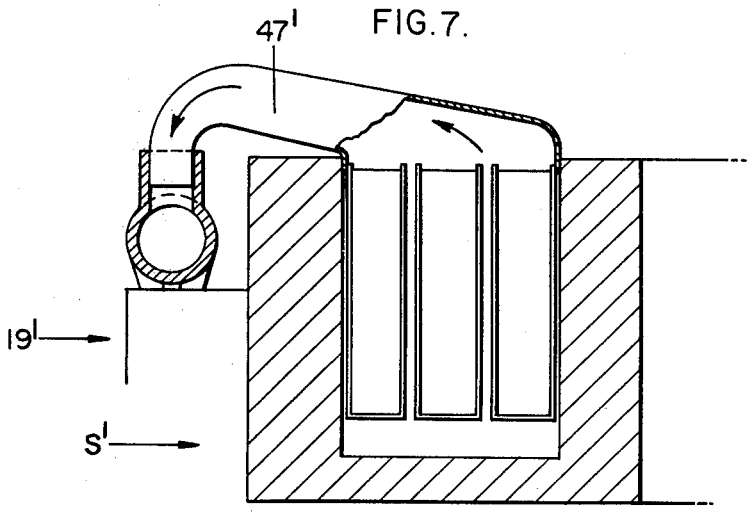
FIG. 7 is an enlarged vertical sectional view along line VII—VII of FIG. 4.
Figure 6:
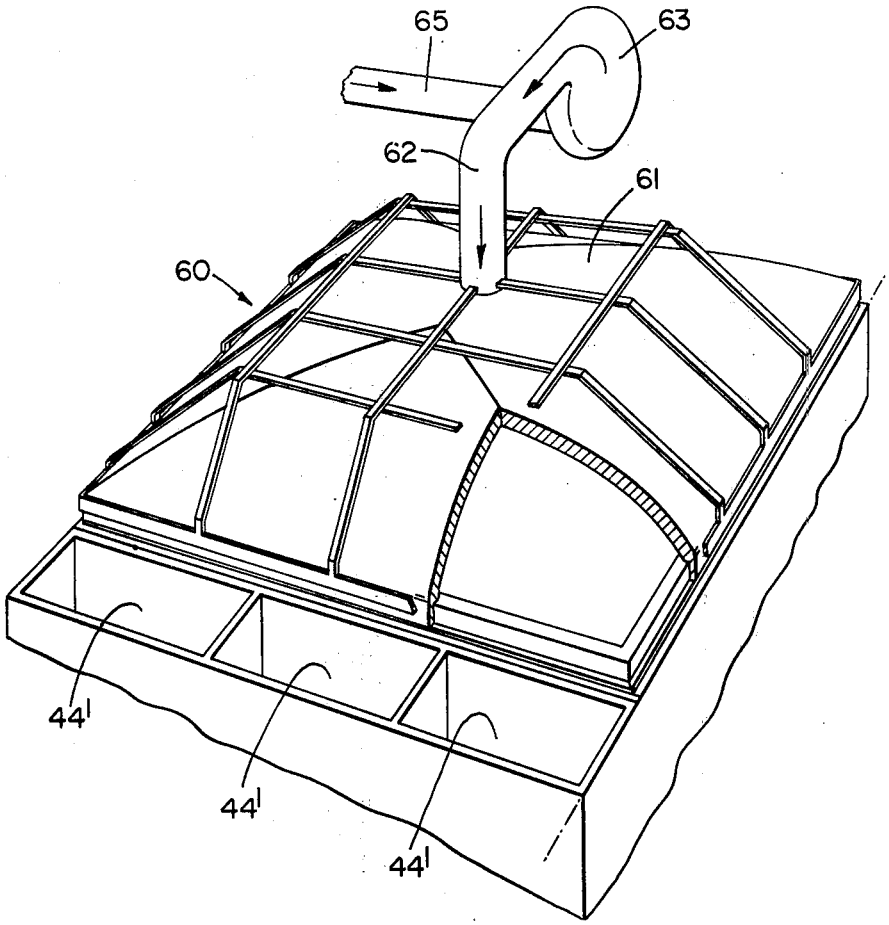
FIG. 6 is a perspective view of the cover member of FIG. 4.

The second embodiment of the member according to the invention is illustrated in FIGS. 4, 5 and 6, wherein similar references with a prime indicate similar parts of FIGS. 1, 2 and 3. As mentioned above, this embodiment is intended to be used in simple Hoffman-type furnaces.

In such furnaces the chambers are not provided with side passages 13 in lower cavities 52' and therefore it is impossible to connect the chambers to smoke channel 19' through the lower cavity.

Thus, according to the invention, it has been devised to connect to smoke channel 19' the upper portion of the chamber, which is in turn the first chamber being cooled.

To this purpose a special movable member is used. Movable member 60 comprises a cover 61 sealing only the muffles of each chamber (not the fire pit 44) and having a central opening receiving, in sealing relationship, the end of a tube 62, wherein a fan 63 is placed.

End 64 of length 65 of tube 62 is provided with a member adapted to be fitted in sealing relationship, in the connecting passage of the vertical passages of smoke channel 19' (similar to length 37 of bridge member 30).

Special movable member 60 will then replace the usual cover 10' of the chamber which is to be connected to channel 19', and therefore in the situation illustrated in FIG. 4, member 60 will replace the cover of chamber D.

Of course, in this type of furnace as well, the situation of the chambers will be identical with the situation disclosed with reference to the first embodiment and therefore it will not be described again herein.

It will be sufficient to add that in both embodiments and in the illustrated situation of the furnaces, chamber R will also be in communication with smoke channel 19, through movable hood 47', as is usual in both types of Hoffman-type furnaces.

It is to be understood that the invention is not restricted to the embodiments here illustrated and described and changes and modifications can be made thereto, without departing from the scope and concepts of the invention.

What is claimed is:

1. In a continuous-ring furnace comprising a plurality of sequentially arranged and communicating chambers where, in the operational mode, each of said chambers being utilized is covered by a movable chamber crown and at least one chamber first in said sequential arrangement is being cooled, at least one chamber intermediary in said sequential arrangement is being heated and at least one chamber last in said sequential arrangement is being pre-heated and wherein hot gases are sequentially caused to flow therethrough;

(a) each of said chambers comprising (1) a central cavity, provided with an upper aperture and containing a plurality of muffles spaced apart to form a plurality of vertical passageways therebetween, said vertical passageways provided with a lower aperture communicating with a lower cavity, said lower cavity formed beneath said central cavity and provided with a side exhausting passage which is normally closed, and (2) a fire pit provided with (i) at least one upper aperture adjacent to and upstream of said upper aperture of said central cavity, said upper aperture of said fire pit of said first chamber in said sequential arrangement being closed, (ii) at least one vertical passage provided with means for heating gases passed therethrough and (iii) a lower aperture connected to and communicating with the lower cavity of the adjacent chamber upstream in said sequential arrangement;

(b) each said chamber crowns being adapted to seat over any one of said chambers and enclose said upper aperture of said central cavity and said upper aperture of said fire pit, whereby a passage is provided for the flow of said hot gases out of the upper aperture of said fire pit and into the upper aperture of said central cavity;

(c) a common smoke channel with separate connection means adjacent to each of said side exhausting passages and adapted to facilitate connection thereto, whereby a portion of the smoke in said common smoke channel can be caused to flow into the adjacent chamber, said connection means being normally closed, and an outlet means for expulsion of smoke from said furnace; and (d) a movable hood, communicating at one end with the aperture of the fire pit adjacent to the last of said chambers in said sequential arrangement, communicating at the other end with the corresponding connection means of said common smoke channel which is open, and adapted to be moved to communicate with any of said chambers and said common smoke channel;

the improvement comprising a movable bridge member connecting an open connection means of said common smoke channel with the adjacent open side exhausting passage of the first chamber in said sequential arrangement, and mounted for movement from one to any other of said chambers, whereby in operation said movable bridge member facilitates the flow of a portion of the smoke from said common smoke channel through said adjacent side exhausting passage and lower cavity and into said first chamber to be recycled through said furnace.

2. In a continuous-ring furnace comprising a plurality of sequentially arranged and communicating chambers where, in the operational mode, all but the first of said chambers being utilized are covered by a movable chamber crown and at least one chamber first in said sequential arrangement is being cooled, at least one chamber intermediary in said sequential arrangement is being heated and at least one chamber last in said sequential arrangement is being pre-heated and wherein hot gases are sequentially caused to flow therethrough;

(a) each of said chambers comprising (1) a central cavity, provided with an upper aperture and containing a plurality of muffles spaced apart to form a plurality of vertical passageways therebetween, said vertical passageways provided with a lower aperture communicating with a lower cavity, said lower cavity formed beneath said central cavity and (2) a fire pit provided with (i) at least one upper aperture adjacent to and upstream of said upper aperture of said central cavity, said upper aperture of said fire pit of said first chamber in said sequential arrangement being closed, (ii) at least one vertical passage provided with means for heating gases passed therethrough and (iii) a lower aperture connected to and communicating with the lower cavity of the adjacent chamber upstream in said sequential arrangement;

(b) each said chamber crowns being adapted to seat over any one of said chambers and enclose said upper aperture of said central cavity and said upper aperture of said fire pit, whereby a passage is provided for the flow of said hot gases out of the upper aperture of said fire pit and into the upper aperture of said central cavity;

(c) a common smoke channel with separate connection means adjacent to each of said chambers and adapted to facilitate connection thereto, whereby a portion of the smoke in said common smoke channel can be caused to flow into the adjacent chamber, said connection means being normally closed, and an outlet means for expulsion of smoke from said furnace; and (d) a movable hood communicating at one end with the aperture of the fire pit adjacent to the last of said chambers in said sequential arrangement, communicating at the other end with the corresponding connection means of said common smoke channel which is open and adapted to be moved to communicate with any of said chambers and said common smoke channel;

the improvement comprising a movable bridge member comprising a modified, movable chamber crown adapted to seat over and enclose only said upper aperture of said first central cavity and a tube connected to and communicating at one end with said modified, movable chamber crown through an aperture therein and at the other end provided with an aperture having means for sealing connection with an open connection means of said common smoke channel adjacent to said first chamber in said sequential arrangement, said movable bridge member being adapted and mounted for movement from one to any other of said chambers, whereby in operation said movable bridge member facilitates the flow of a portion of the smoke from said common smoke channel into said chamber to be recycled through said furnace.

* * * * *